US008782999B2

(12) United States Patent
Kondo et al.

(10) Patent No.: US 8,782,999 B2
(45) Date of Patent: Jul. 22, 2014

(54) TABLET SUPPLY APPARATUS

(75) Inventors: Akira Kondo, Moriguchi (JP); Takashi Mori, Moriguchi (JP); Koichi Kobayashi, Moriguchi (JP)

(73) Assignee: Panasonic Healthcare Co., Ltd., Toon-shi (JP)

( * ) Notice: Subject to any disclaimer, the term of this patent is extended or adjusted under 35 U.S.C. 154(b) by 377 days.

(21) Appl. No.: 12/569,013

(22) Filed: Sep. 29, 2009

(65) Prior Publication Data

US 2010/0077707 A1 Apr. 1, 2010

(30) Foreign Application Priority Data

Sep. 30, 2008 (JP) ..... 2008-252494

(51) Int. Cl.

| | |
|---|---|
| ***B65B 5/02*** | (2006.01) |
| ***B65B 5/06*** | (2006.01) |
| ***B65B 5/10*** | (2006.01) |
| ***G07F 17/00*** | (2006.01) |

(52) U.S. Cl.

CPC ..... *B65B 5/103* (2013.01); *G07F 17/0092* (2013.01)

USPC ..... 53/247; 53/244; 53/248

(58) Field of Classification Search

USPC ..... 53/242, 244, 248, 468

See application file for complete search history.

(56) References Cited

U.S. PATENT DOCUMENTS

| | | | | |
|---|---|---|---|---|
| 4,267,942 | A * | 5/1981 | Wick et al. | 221/2 |
| 4,415,098 | A * | 11/1983 | Haas | 221/202 |
| 4,573,606 | A * | 3/1986 | Lewis et al. | 221/2 |
| 4,680,464 | A * | 7/1987 | Bross | 250/223 R |
| 5,101,612 | A * | 4/1992 | Yamamoto et al. | 53/499 |
| 5,348,061 | A * | 9/1994 | Riley et al. | 141/104 |
| 5,481,855 | A * | 1/1996 | Yuyama | 53/493 |
| 5,737,902 | A * | 4/1998 | Aylward | 53/475 |
| 5,765,606 | A * | 6/1998 | Takemasa et al. | 141/104 |
| 6,345,487 | B1 * | 2/2002 | Luciano et al. | 53/54 |
| 6,349,999 | B1 * | 2/2002 | Takahashi et al. | 312/209 |
| 6,421,982 | B1 * | 7/2002 | Eichenberger | 53/253 |
| 6,449,921 | B1 * | 9/2002 | Kim | 53/154 |
| 6,457,611 | B1 * | 10/2002 | Koehler | 222/462 |
| 6,705,487 | B2 * | 3/2004 | Kim | 221/312 B |
| 7,472,526 | B2 * | 1/2009 | Pearson | 53/473 |
| 7,587,878 | B2 * | 9/2009 | Kim | 53/246 |

(Continued)

FOREIGN PATENT DOCUMENTS

| | | |
|---|---|---|
| JP | 10-323382 A | 12/1998 |
| JP | 2004-203433 A | 7/2004 |

*Primary Examiner* — Hemant M Desai
*Assistant Examiner* — Gloria R Weeks
(74) *Attorney, Agent, or Firm* — Westerman, Hattori, Daniels & Adrian, LLP

(57) ABSTRACT

A tablet supply apparatus including a main body having a case accommodating unit at the upper portion thereof, plural tablet cases that are secured in the case accommodating unit and in which tablets are accommodated, a chute through which tablets discharged from each of the tablet cases drop, a hopper that is disposed below the chute and provided in the main body, a filling device for filling tablets received by the hopper into a container, and at least one tablet feeder for freely putting into the hopper tablets whose kinds are other than the kinds of the tablets accommodated in the table cases. The tablet feeder has an opening for putting tablets, a shutter for temporarily trapping the tables put from the opening and a switch for opening the shutter, and is designed so that the put tablets on the shutter are visually recognizable.

6 Claims, 11 Drawing Sheets

(56) References Cited

U.S. PATENT DOCUMENTS

| | | | | |
|---|---|---|---|---|
| 7,641,073 | B2 * | 1/2010 | Kim | 221/171 |
| 7,726,095 | B2 * | 6/2010 | Yuyama et al. | 53/247 |
| 7,827,764 | B2 * | 11/2010 | Yuyama et al. | 53/247 |
| 7,848,846 | B2 * | 12/2010 | Uema et al. | 700/243 |
| 7,856,794 | B2 * | 12/2010 | Zieher | 53/246 |
| 7,861,491 | B2 * | 1/2011 | Yuyama et al. | 53/52 |
| 7,878,366 | B2 * | 2/2011 | Cicognani | 221/7 |
| 7,894,656 | B2 * | 2/2011 | Kim | 382/141 |
| 8,020,356 | B2 * | 9/2011 | Yuyama et al. | 53/52 |
| 8,387,343 | B2 * | 3/2013 | Yasunaga et al. | 53/55 |
| 2003/0057231 | A1 * | 3/2003 | Kim | 221/263 |
| 2004/0074916 | A1 * | 4/2004 | Priebe et al. | 221/289 |
| 2004/0134043 | A1 * | 7/2004 | Uema et al. | 24/297 |
| 2008/0314002 | A1 * | 12/2008 | Yuyama et al. | 53/531 |
| 2010/0018986 | A1 * | 1/2010 | Kodama et al. | 221/8 |
| 2010/0043349 | A1 * | 2/2010 | Yuyama et al. | 53/52 |
| 2010/0077708 | A1 * | 4/2010 | Kobayashi et al. | 53/501 |
| 2010/0107555 | A1 * | 5/2010 | Yuyama et al. | 53/131.2 |

* cited by examiner

FIG.8

| | | FIRST PACKAGE | 2ND PACKAGE | 3RD PACKAGE | - - - | 100-TH PACKAGE |
|---|---|---|---|---|---|---|
| | | PATIENT J1 | PATIENT J2 | PATIENT J3 | - - - | PATIENT J100 |
| PRESENCE OF TC | MEDICINE T1 | ONE TABLET | | | | TWO TABLETS |
| | MEDICINE T2 | | TWO TABLETS | | | |
| | MEDICINE T3 | | | ONE TABLET | | |
| | ⋮ | | | | | |
| | MEDICINE T320 | | | | | |
| ABSENCE OF TC | MEDICINE X1 | | ONE TABLET | | | |
| | MEDICINE X2 | | | | | |
| | MEDICINE X3 | | | | | ONE TABLET |
| | ⋮ | | | | | |
| | MEDICINE X50 | | | | | |

TABLET SUPPLY APPARATUS

INCORPORATION BY REFERENCE

The present application claims priority under 35 U.S.C. §119 to Japanese Patent Application No. 2008-252494 filed on Sep. 30, 2008. The content of the application is incorporated herein by reference in its entirety.

BACKGROUND OF THE INVENTION

1. Field of the Invention

The present invention relates to a tablet supply apparatus having a function of filling tablets into a container such as a bag, a bin or the like.

2. Description of Related Art

There has been hitherto known a tablet supply apparatus in that a plurality of tablet cases accommodated according to category (kind) are provided, predetermined kinds of tablets are taken out from tablet cases on the basis of input prescription data into a hopper, the collected tablets are filled from the hopper into a container such as a bag, a bin or the like and a container in which desired kinds of tablets are filled is automatically prepared. As one of the above type tablet supply apparatuses has been proposed a tablet supply apparatus having a tablet feeder for adding the tablet supply apparatus with a tablet which has not yet been set in any table case when it is required to fill a container with the tablet concerned (for example, see JP-A-2004-203433). In the tablet supply apparatus disclosed the above publication, plural accommodating compartments are formed in the tablet feeder. When an operation of filling tablets into a container is started, it is instructed to an operator in advance which kind of tablets should be put into which accommodating compartment, and the operator beforehand executes an advance preparation of putting a predetermined kind of tablets into a predetermined accommodating compartment on the basis of this instruction. After the advance preparation is finished, an operation of filling tablets into a container is started by the tablet supply apparatus.

However, the tablet supply apparatus described above has a problem that the advance preparation which is executed by the operator before the operation of filling tablets into a container is cumbersome. Particularly, when various kinds of tablets are to be put into the accommodating compartment, the operation is required to be prudential to execute the putting work because the accommodating compartment is small, and thus there is a problem that the putting work become troublesome.

SUMMARY OF THE INVENTION

The present invention has been implemented in view of the foregoing situation, and has an object to provide a tablet supply apparatus that facilitates an advance preparation executed by an operator before an operation of filling tablets into a container such as a bag, a bin or the like.

In order to attain the above object, a tablet supply apparatus according to the present invention comprises: a main body having a case accommodating unit at the upper portion thereof; plural tablet cases that are secured in the case accommodating unit and in which tablets are accommodated; a chute through which tablets discharged from each of the tablet cases drop; a hopper that is disposed below the chute and provided in the main body; a filling device for filling tablets received by the hopper into a container; and at least one tablet feeder for freely putting into the hopper tablets whose kinds are other than the kinds of the tablets accommodated in the table cases, wherein the tablet feeder has a tablet putting opening for putting tablets, a shutter for temporarily trapping the tables put from the tablet putting opening and a switch for opening the shutter, and has a tablet putting space through which the tablets which are put from the tablet putting opening and temporarily trapped on the shutter are visually recognizable.

In the above tablet supply apparatus, the switch may be provided in the neighborhood of the tablet feeder.

In the above tablet supply apparatus, the tablet feeder may have a lid member that freely opens and closes the tablet putting opening, and the switch may be a switch interlocking with a closing operation of the lid member.

In the above tablet supply apparatus, a plurality of the tablet feeders may be provided so as to be arranged side by side.

According to the present invention, before tablets are filled into a container such as a bag, a bin or the like, an advance preparation of putting a predetermined kind of tablets into a predetermined accommodating compartment of a tablet feeder can be simplified, and the workability can be also enhanced.

BRIEF DESCRIPTION OF THE DRAWINGS

FIG. 8 is a schematic diagram showing an example of filling tablet data;

DETAILED DESCRIPTION OF THE PREFERRED EMBODIMENT

A preferred embodiment according to the present invention will be described with reference to the accompanying drawings.

Figure 1:
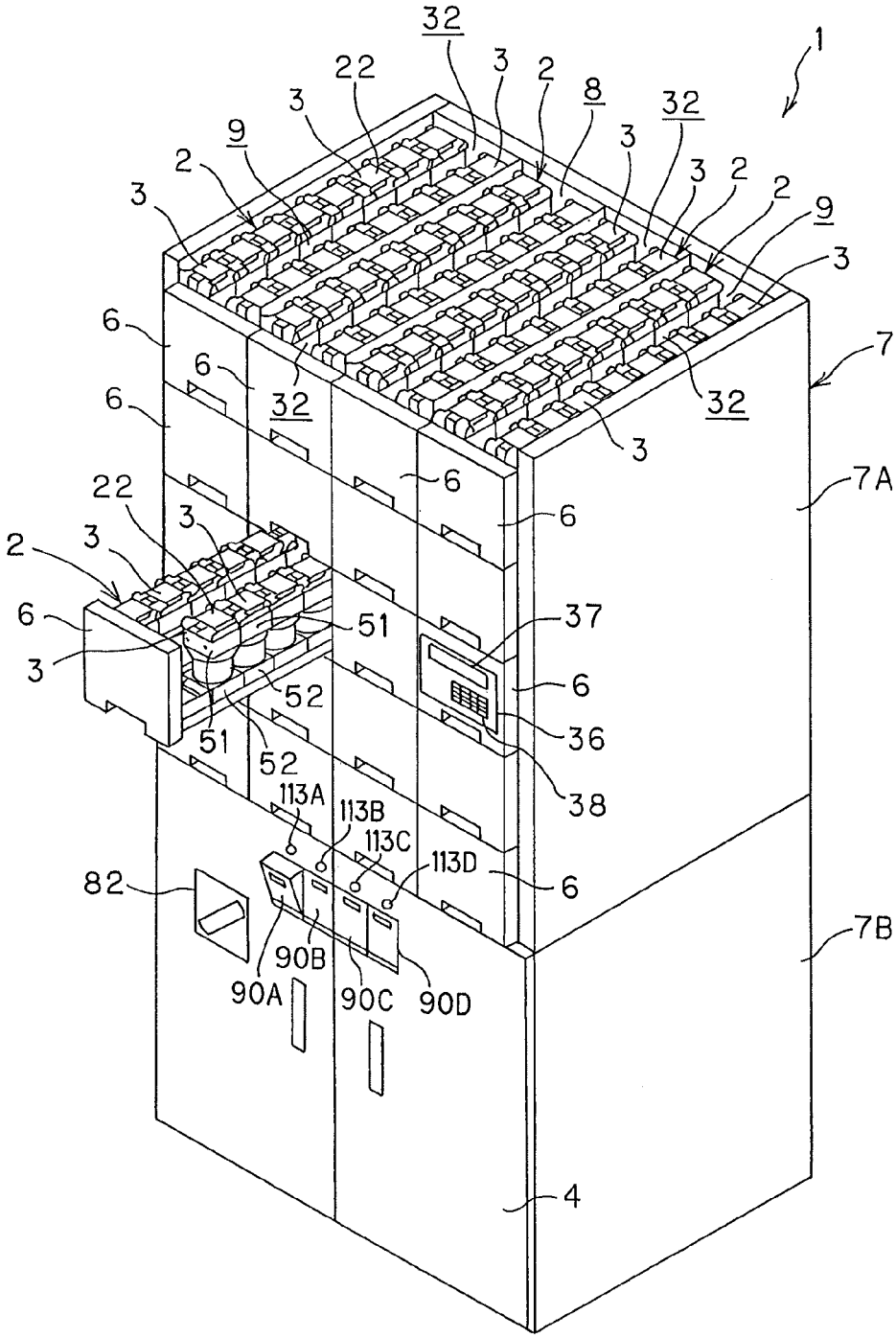
FIG. 1 is a perspective view showing a tablet supply apparatus.
Figure 2:
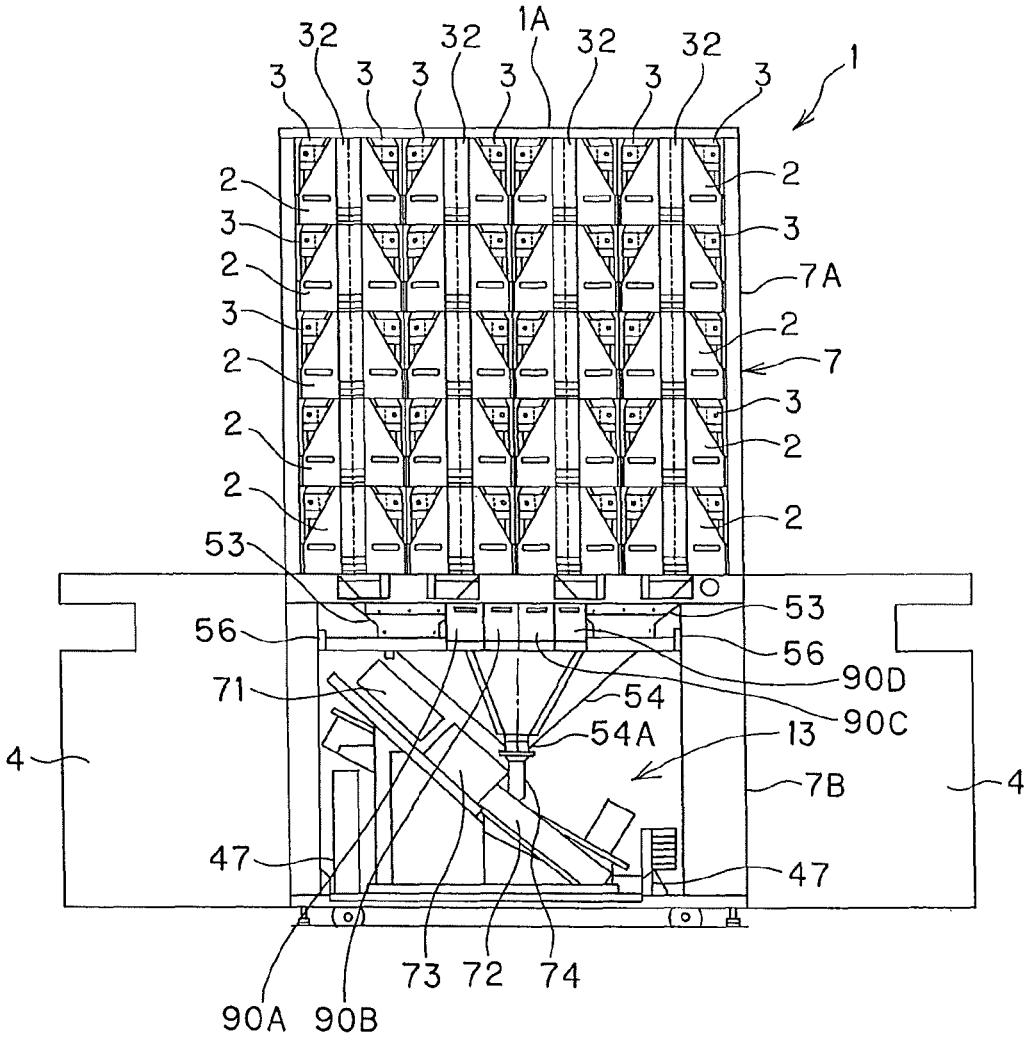
FIG. 2 is a front view of the tablet supply apparatus.
Figure 3:
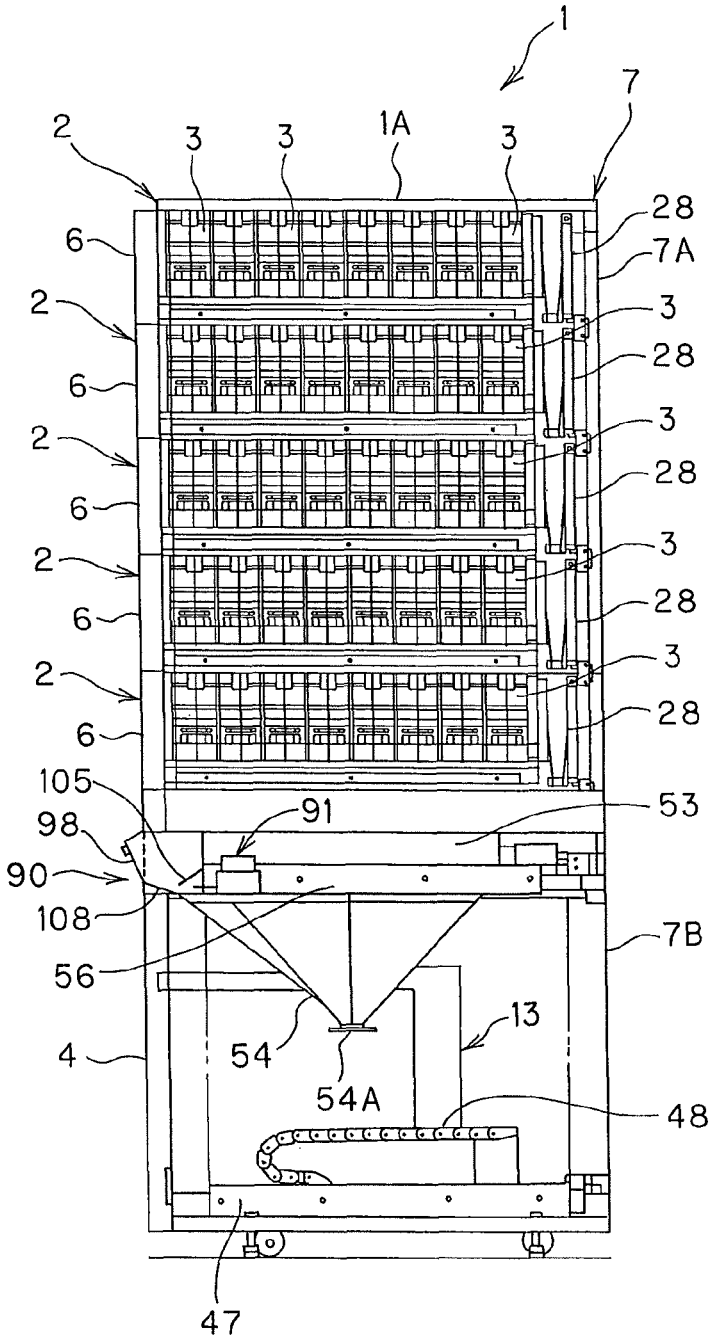
FIG. 3 is a perspective view of the tablet supply apparatus.

FIG. 1 is a perspective view showing a tablet supply apparatus (excluding a top plate 1A) according to a first embodiment of the present invention, FIG. 2 is a front view of a tablet supply apparatus under the state that a door panel 6 of each shelf 2 and a lower panel 4 is opened, and FIG. 3 is a longitudinally sectional side view of the tablet supply apparatus. In the following description, the term "tablet" is used as a target to be packaged. However, this term is broadly interpreted so as to cover general medicines such as not only narrowly-defined tablets (small round solid pieces of medicine), but also encapsulated or wrapped powder or liquid medicine, etc. in the following description.

The tablet supply apparatus 1 is installed in a hospital, a dispensing pharmacy or the like, and has a laterally elongated rectangular main body 7. The main body 7 comprises an upper structure 7A and a lower structure 7B which can be mutually separated from each other, and it is configured so that the upper structure 7A is stacked on and jointed to the lower structure 7B. A case accommodating unit 8 in which tablet cases 3 are accommodated is constructed in the upper structure 7A so that the front, upper and lower surfaces thereof are opened, and the opened top surface of the case accommodating unit 8 is covered by a detachable top plate 1A.

The lower structure 7B is designed so that the front and upper surfaces thereof are opened, and it communicates with the upper structure 7A at the upper surface thereof. A packaging machine 13, etc. as a filling unit described later are accommodated and installed in the lower structure 7B, and the opening of the front surface is closed by hinged double panels (gatefold type panels) 4 so as to be freely openable and closable. A take-out port 82 is formed in the lower panel 4 at the left side in front view out of the lower panels 4. This take-out port 82 is provided to take out a separate package in which predetermined type and predetermined number of tablets are filled. A separate package filled with tablets is fed to the take-out port 82, and an operator takes out the thus-fed separate package from the take-out port 82.

Shelves 2 of four columns in the right-and-left direction and five stages in the up-and-down direction (totally, twenty shelves 2) are installed in the case accommodating unit 8 of the upper structure 7A. A door panel 6 is secured to the front end of each shelve 2, and the respective door panels 6 close the opened front surface of the upper structure 7A (case accommodating unit 8) under the state that all the shelves 2 are accommodated in the case accommodating unit 8. A passage 9 which is opened in the up-and-down direction is formed at the center of each shelve 2 so as to extend in the front-and-rear direction, and every eight driving bases 52 of the tablet cases 3 (totally 16 driving bases 52) are arranged in the front-and-rear direction in juxtaposition with on one another at both the right and left sides of this passage 9. The tablet case 3 comprises the driving base 52 and an accommodating container 51 joined to the upper side of the driving base 52.

As shown in FIG. 1, a control panel 36 is secured to one of the plural door panels 6. The control panel 36 has a display unit 37 and an input unit 38. The display unit 37 is a device for displaying various kinds of information, and it is constructed by a liquid crystal display panel. The input unit 38 is a device for inputting an instruction to the tablet supply apparatus 1 by the operator, and it has plural operating switches.

In the driving base 52 are mounted a drum motor 14 (FIG. 7) as a drum driving motor comprising a brush-attached DC motor, and an optical type tablet detecting sensor 18 (FIG. 7) for detecting tablets discharged from the tablet case 3. The upper surface of the accommodating container 51 of the tablet case is opened, and this opening is closed by a freely openable/closable lid 22. A discharge drum (not shown) is secured to the inner bottom portion of the accommodating container 51, and plural longitudinal grooves are formed at predetermined intervals around the side surface of the discharge drum. Tablets are filled from the opened upper surface into the accommodating container 51 (the lid 22 is opened), and every two tablets are put into each longitudinal groove of the discharge drum.

The accommodating unit 51 is mounted on the driving base 52 described above so as to be detachably joined to the driving base 52, thereby constructing the tablet case 3. At this time, the discharge drum is freely detachably engaged with the driving shaft of the drum motor 14. When the drum motor 14 is forwardly rotated, the discharge drum is forwardly rotated, and the longitudinal grooves are successively coincident with a discharge port (not shown) of the driving base 52 so that the tablets in the longitudinal grooves are discharged one by one. The discharged tablet is detected by the tablet detecting sensor 18.

The shelf 2 to which plural tablet cases 3 are secured as described above is detachably fixed through screws to a pair of right and left drawing rails (not shown) secured in the case accommodating unit 8 of the upper structure 7A. Accordingly, the shelves 2 and the plural tablet cases 3 secured to the shelves 2 are accommodated in the case accommodating unit 8 so as to be freely drawn out from the case accommodating unit 8, and also they are detachable from the drawing rails under the state that they are drawn out from the case accommodating unit 8.

At the rear end of the shelve 2 is detachably mounted a harness 28 (FIG. 3) for supplying current (supplying power) to the drum motor 14 of the tablet case 3, transmitting an output of the tablet detection sensor 18, etc. This harness 28 has a dimension longer than the draw-out distance of the shelve 2.

The passages 9 of the respective shelves 2 located in the vertical direction are mutually matched (aligned) with one other so as to intercommunicate with one another in the vertical direction under the state that the shelves 2 are accommodated in the case accommodating unit 8, thereby constituting a vertically-extending chute 32. Accordingly, in this embodiment, four vertically-extending chutes are constructed on four columns in the right and left direction respectively in the case accommodating unit 8. As described above, the shelves 2 which can be freely and independently drawn out are provided at the plural stages in the vertical direction in the case accommodating unit 8. Accordingly, when an accommodating container 51 of a tablet case 3 is exchanged or the like, each shelve 2 can be independently drawn out. Accordingly, as compared with the structure that the respective shelves 2 located on one column in the vertical direction must be drawn out simultaneously (in a lump), the gap which must be provided between the shelves 2 at the upper and lower sides to exchange the accommodating containers 51 can be shortened. Accordingly, the number of tablet cases 3 which can be accommodated in the case accommodating unit 8 can be increased. Furthermore, the passage 9 is formed at the center of each shelve 2, and the vertically extending chute 32 is constructed under the state that the shelves 2 located in the vertical direction are accommodated in the case accommodating unit 8. Therefore, as compared with the construction that a chute is formed at the side portions of the shelves 2, the interval between chutes 32 located at both the right and left ends can be shortened. Accordingly, the opening area of the upper surface of each of shutters 53 and a hopper 54 described later can be reduced, and thus they can be miniaturized.

The packaging machine 13 (filling device) is mounted at the lower portion in the lower structure 7B of the main body 7. As shown in FIG. 3, the packaging machine 13 is detachably secured through screws to drawing rails 47 which are fixed to the right and left sides of the bottom surface of the lower structure 7B. Accordingly, the packaging machine 13 can be freely drawn out from the inside of the lower structure 7B to the front side thereof under the state that the lower panels 4 are opened. Furthermore, the packing machine 13 can be detached from the drawing rails 47 under the state the packaging machine 13 is drawn out. Reference numeral 48 represents a harness for the packaging machine which is freely detachably connected through a connector between the packaging machine 13 and the lower structure 7B, and the length of the harness 48 is set to be so long that the packaging machine 13 can be drawn out by a sufficient draw-out amount.

Figure 7:
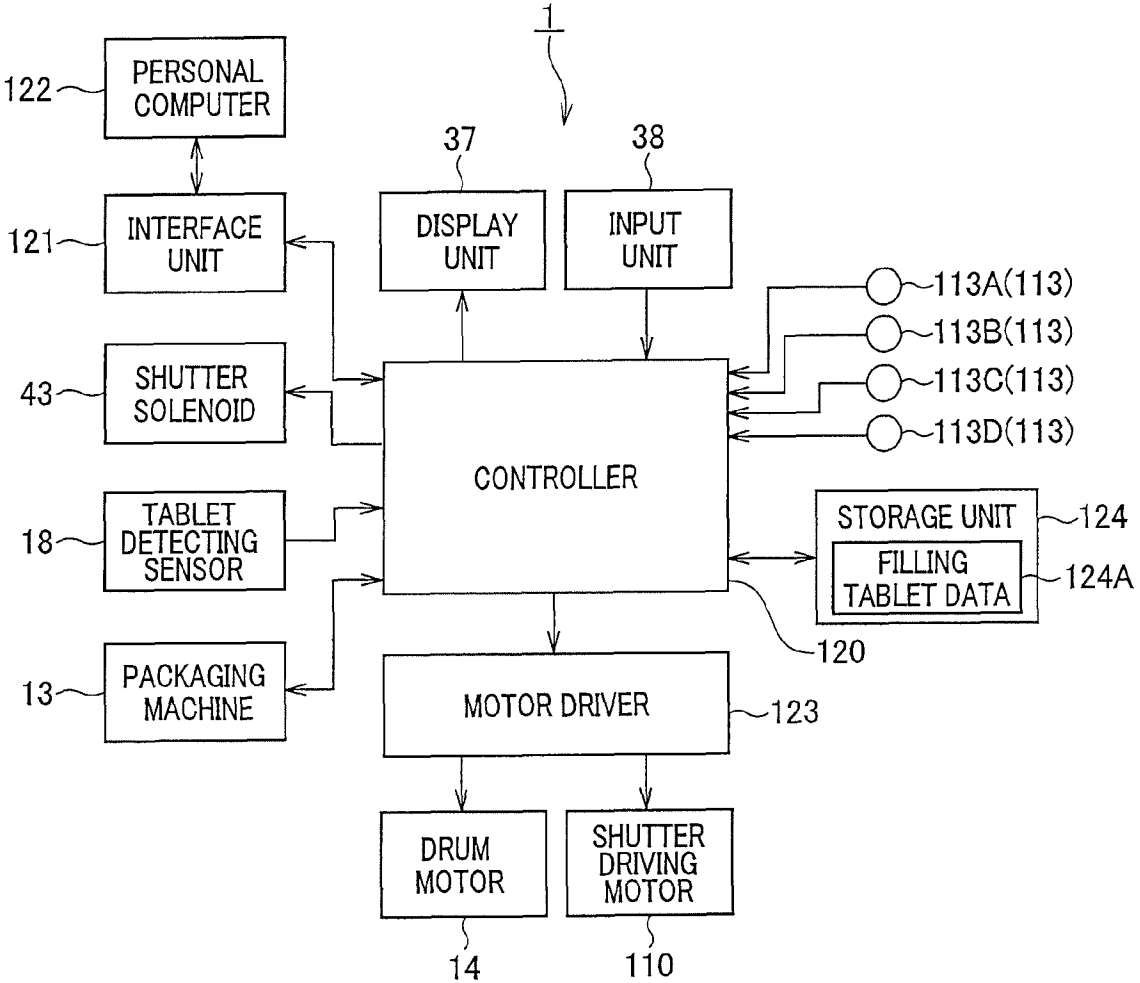
FIG. 7 is a block diagram showing a functional construction of the tablet supply apparatus.

The two shutters 53 are juxtaposed with one another at the upper portion in the lower structure 7B. Each of the shutters 53 is actuated by a shutter solenoid 43 (FIG. 7). Each of the shutters 53 is located at the lower side of the chute 32. The right-side shutter 53 (in front view of FIG. 2) correspond to the chute 32 located at the right end and the chute 32 located at the left side of the right-end chute 32, and the left-side shutter 53 (in front view of FIG. 2) correspond to the chute 32 located at the left end and the chute 32 located at the right side of the left-end chute 32. Each shutter 53 serves to temporarily trap tablets dropping from each chute 32 to the hopper 54 described later.

The hopper 54 is provided in the lower structure 7B so as to correspond to the lower side of each shutter 53. The hopper 54 is designed in such a funnel shape that the upper surface thereof is broadly opened and the body thereof is gradually narrowed toward the lower end thereof. The hopper 54 receives tablets which drop from each chute and pass through each shutter 53, and discharges the tablets from the lower-end opening 54A.

The right and left upper ends of the hopper 54 are detachably secured through screws to drawing rails 56 which are fixed to the right and left upper portions in the lower structure 7B. Accordingly, the hopper 54 and the shutters 53 can be freely drawn out from the inside of the lower structure 7B to the front side thereof at the same time under the state that the lower panels 4 are opened, and further they can be detachably mounted on the drawing rails 56 under the state that the drawing rails 56 are drawn out.

According to the construction as described above, when exchange of the table case 3 or maintenance such as cleaning of the chutes 32 constructed by the respective passages 9, part exchange of the packaging machine 13 or the like is carried out, these elements are drawn out from the upper structure 7A or the lower structure 7B of the main body 7 and the work of detaching these elements is executed.

Accordingly, the maintenance workability of the tablet supply apparatus can be remarkably enhanced, and the tablet filling can be smoothly implemented. Particularly, the tablet cases 3 can be simultaneously drawn out from the upper structure 7A together with each shelf 2, and the accommodating containers 51 can be detachably mounted on the tablet cases 3. Therefore, the exchange workability of the accommodating containers 51 of the tablet cases 3 can be further enhanced.

Figure 4:
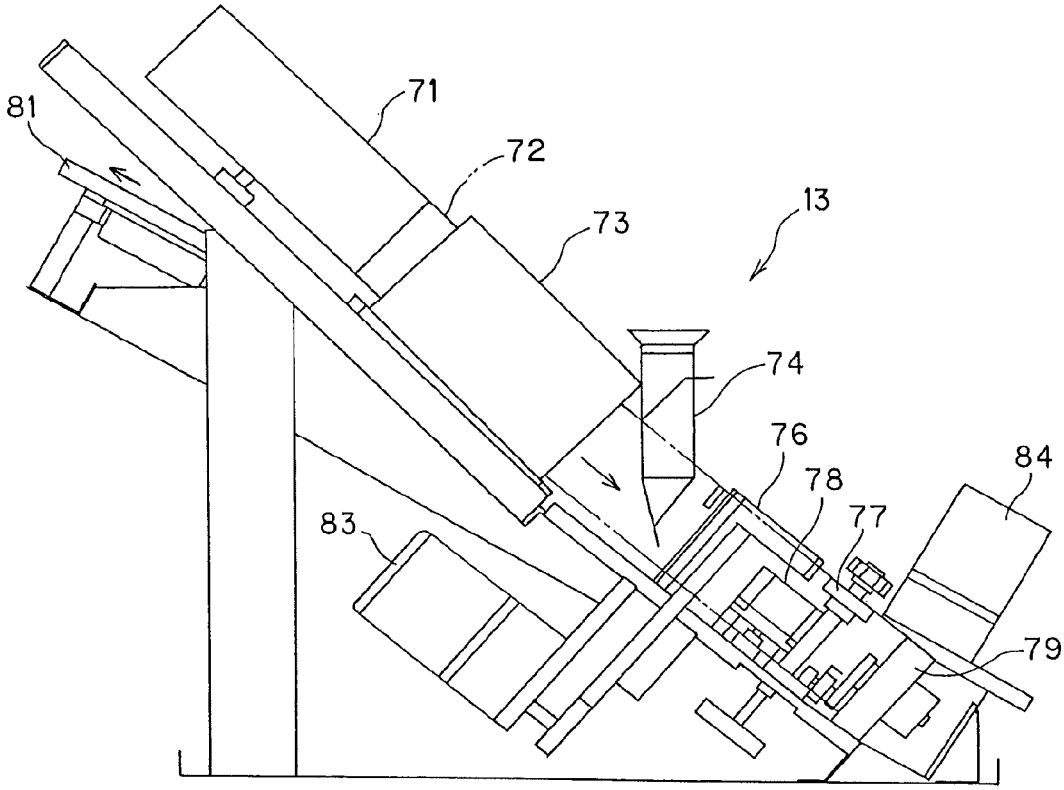
FIG. 4 is a front view of a packaging machine.

FIG. 4 is a front view of the package machine 13.

Under the control of a controller 120 described later, the packaging machine 13 prints predetermined characters or an image on a packaging sheet 72 according to prescription information, fills tablets into the packaging sheet 72, compartments the packaging sheet every package, cuts the packaging sheet on a prescription basis, that is, on a patient basis, continuously prepares separate packages each of which is filled with desired kind and number (amount) of tablets and then feeds the separate package thus prepared to the take-out port 82.

In FIG. 4, reference numeral 71 represents a roll around which thermally adhesive (heat-weldable) packaging sheet 72 (constituting a container) is wound, reference numeral 73 represents a printer, reference numeral 74 represents a nozzle secured to the lower-end opening 54A of the hopper 54, reference numeral 76 represents a heat seal head formed of silicon rubber, reference numeral 77 represents a roller for feeding the package sheet 72 drawn out from the roll 71, reference numeral 79 represents a cutter for cutting the packaging sheet 72, and reference numeral 81 represents a conveyor for feeding the separated and cut-out package sheet 72 to the take-out port 82 provided to the lower panel 4. These elements are successively provided along the feed passage of the packaging sheet 72. Reference numeral 83 represents a motor for operating the thermal seal head 76, reference numeral 78 represents a motor for driving the roller 77 and reference numeral 84 represents a motor of the conveyor 81.

Here, the basic operation of the packaging machine 13 will be described.

The packaging sheet wound around the roll 71 is designed have a substantially V-shaped section, and it is formed by folding longitudinally-extending packaging sheet in half along the center line thereof in the longitudinal direction thereof so that the upper surface thereof is opened. The package sheet 72 is drawn out obliquely, that is, diagonally downward right from the roll 71 by the roller 77 or the like, and then the surface thereof is printed by the printer 73. Subsequently, tablets discharged from the nozzle 74 are filled in the package sheet 72, and the package sheet is compartmented on a separate package basis by thermal adhesion (heat welding) of the thermal seal head 76. The compartmented and packaged package sheet 72 is cut out by a cutter 79, whereby separate packages each of which is filled with predetermined kind and number (amount) of tablets are prepared one by one. The separate packages thus prepared are fed to the take-out port 82 by the conveyor 81.

Tablet feeders 90A, 90B, 90C and 90D (hereinafter represented by reference numeral 90 unless they are not particularly discriminated from one another) for adding the tablet supply apparatus 1 with tablets which are not set in the tablet cases 3 are provided at the center of the upper portion of the lower structure 7B. In this embodiment, as shown in FIG. 1, the four tablet feeders 90 are laterally arranged side by side at the center of the upper portion of the lower structure 7B.

Figure 5:
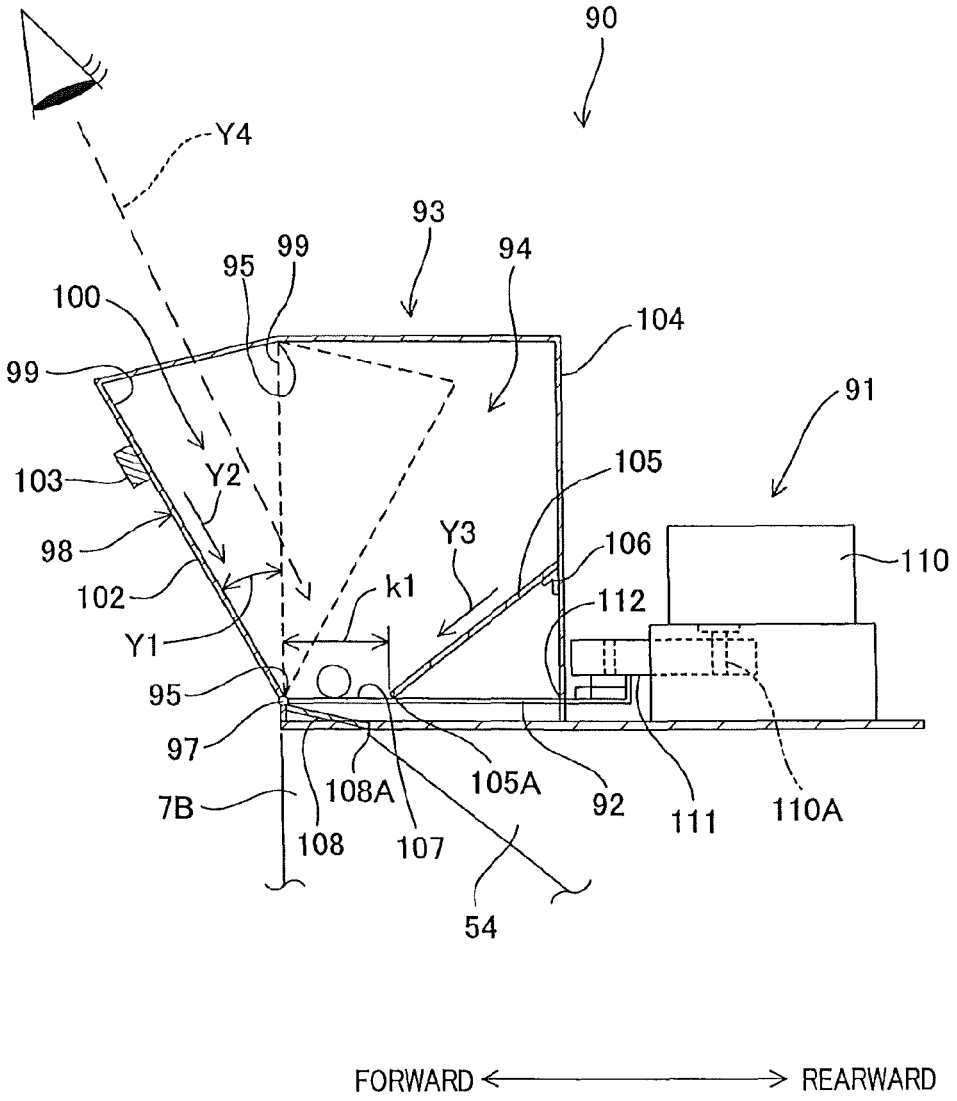
FIG. 5 is a side view of a tablet feeder under a state that a shutter is closed.
Figure 6:
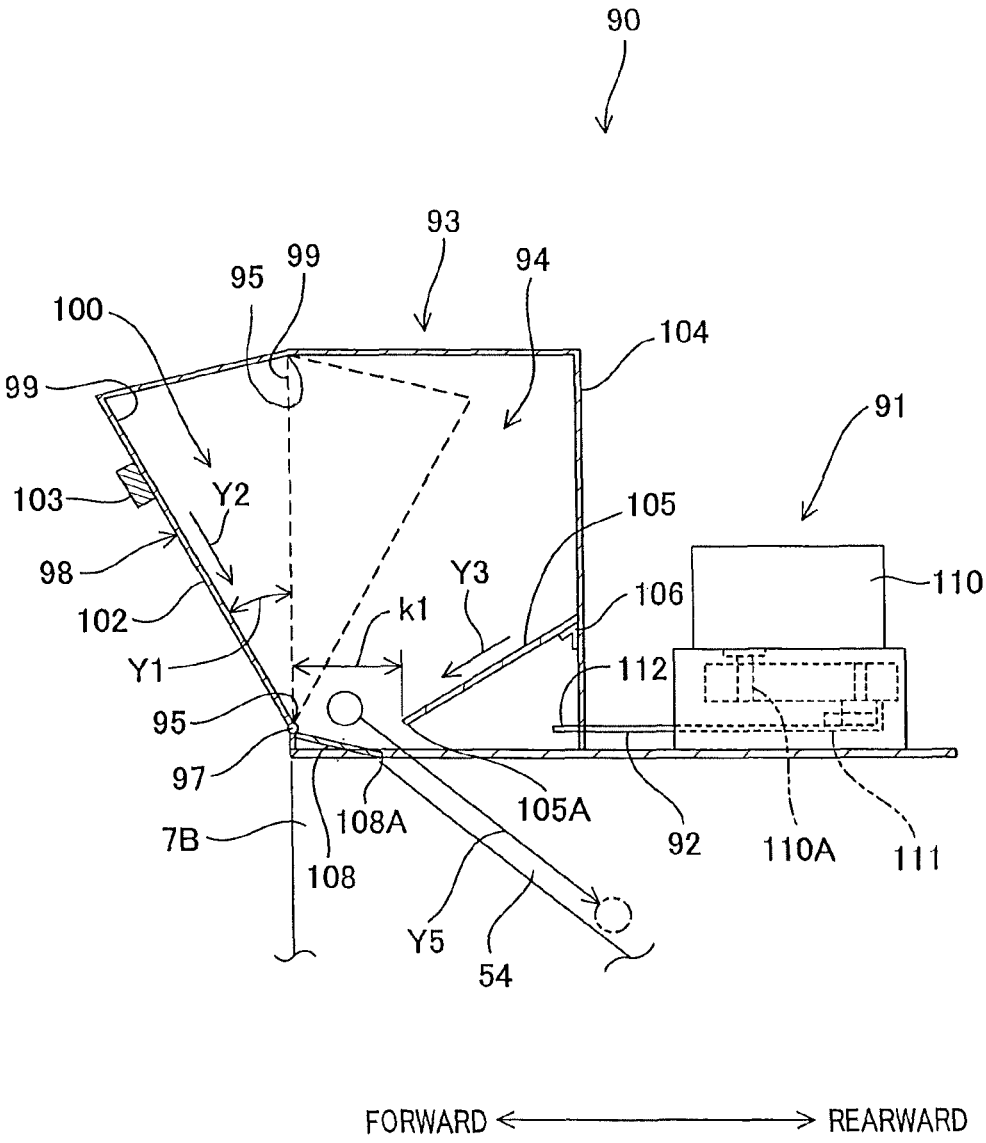
FIG. 6 is a side view of the tablet feeder under a state that the shutter is opened.

FIGS. 5 and 6 are side views (partially cross-sectional view) of the tablet feeder 90. FIG. 5 shows a state that a shutter plate 92 of a shutter unit 91 (shutter) provided to the tablet feeder 90 is closed, and FIG. 6 shows a state that the shutter plate 92 is opened.

As shown in FIGS. 5 and 6, the tablet feeder 90 has a substantially box-shaped tablet feeder main body 93 and a shutter unit 91. A tablet putting space 94 is formed in the tablet feeder main body 93, and a case opening 95 is formed in the whole area of the front surface of the tablet feeder main body 93, whereby tablets can be put through the case opening 95 into the tablet putting space 94.

A lid member 98 is provided at the position corresponding to the case opening 95 so as to be swingable within a predetermined range (the range indicated by an arrow Y1 in FIGS. 5 and 6) around the shaft 97. When the lid member 98 is set to an open state (the state indicated by a solid line in FIGS. 5 and 6), a tablet putting port opened upwardly (an opening for putting tablets) is formed (see FIG. 1), and a tablet passage 100 through which the tablet putting port 99 and the tablet putting space 94 intercommunicate with each other is formed. Accordingly, when the lid member 98 is set to the open state and then tables are put into the tablet putting port 99, the tablets are successively passed through the tablet passage 100 and the case opening 95, and then put into the tablet putting space 94.

On the other hand, when the lid member 98 is set to a close state (the state indicated by a broken line in FIGS. 5 and 6), the case opening 95 is closed by a lid member front face 102 formed on the front surface of the lid member 98. The lid member 98 is set to the close state while the tablet feeder 90 is not used, whereby foreign materials such as dust, etc. can be prevented from invading into the tablet putting space 94. The lid member front face 102 is provided with a knob 103 projecting forwardly, and the operator sets the lid member 98 to the open state or close state by grasping the knob 103.

A slope plate 105 which is inclined downwardly toward the front side is secured to the rear surface 104 of the tablet feeder main body 93 through a securing member 106. A gap K1 is formed between the lower end 105A of the slope plate 105 and the front surface of the tablet feeder 90. As described later, the slope plate 105 is a member through which tablets put into the tablet feeder 90 are led to a tablet collecting portion 107 (see FIG. 5) formed at the position corresponding to the gap K1.

A lead-in plate 108 which is inclined downwardly toward the rear side is provided at the lower side of the gap K1. The lead-in plate 108 is a member through which tablets dropping through the gap K1 are led to the hopper 54. The lower end 108A of the lead-in plate 108 is joined to the upper edge of the hopper 54, and the tablets dropping through the gap K1 are surely introduced into the hopper 54.

On the other hand, as shown in FIGS. 5 and 6, the shutter unit 91 has a shutter driving motor 110, a joint member 111 is secured to the driving shaft 110A of the shutter driving motor 110, and a shutter plate 92 is secured to the joint member 111. The shutter plate 92 is a flat-plate member having substantially the same width-direction length as the width-direction length of the tablet feeder main body 93, and the shutter plate 93 extends into the tablet feeder main body 93 through a penetration hole 112 formed in the rear surface of the tablet feeder main body 93.

The shutter plate 92 is designed to move in the front-and-rear direction according to the driving of the shutter driving motor 110. As shown in FIG. 5, when the shutter plate 91 is set to the close state under which it is moved to the forefront, the gap K1 described above is closed by the shutter plate 92, and thus the tablet collecting portion 107 is formed at the position on the shutter plate 92 which corresponds to the gap K1. In this embodiment, when the lid member 98 is set to the open state and tablets are put into the tablet putting space 94, the tablets are collected at the tablet collecting portion 107. Specifically, when the lid member 98 is under the open state, the lid member front face 102 of the lid member 98 is set to be inclined to the tablet collecting portion 107. Accordingly, the put tablets are led into the tablet collecting portion 107 as indicated by the arrow Y2 by the slope of the lid member front face 102, and also the put tablets are led to the tablet collecting portion 107 as indicated by the arrow Y3 by the slope of the slope plate 105. As indicated by the broken-line arrow Y4 of FIG. 5, the tablet collecting portion 107 is formed at the front portion of the lower surface of the tablet putting space 94 at which the operator can surely view it when the operator peeps at the tablet putting space 94 through the tablet putting port 99. Accordingly, when the operator puts tablets into the tablet feeder 90, the put tablets are collected at the tablet collecting portion 107, and the operator can surely view the tablets collected in the tablet collecting portion 107.

Furthermore, as shown in FIG. 6, when the shutter plate 91 is set to the open state under which it is moved to the rear most position, the gap K1 described above is opened. Accordingly, when the shutter plate 92 is set to the open state from the state under which the shutter plate 92 is set to the close state and tablets exist on the tablet collecting portion 107, the tablets drop through the gap K1 (see the arrow Y5 of FIG. 6). As described above, the dropping tablets are led to the lead-in plate 108, and then introduced into the hopper 54. The shutter plate 92 is controlled to be set to the close state while it is not instructed that the shutter plate 92 is set to the open state by shutter opening/closing switches 113A, 113B, 113C, 113D (switches) described later.

As shown in FIG. 1, four push type shutter opening/closing switches 113A, 113B, 113C and 113D (particularly hereinafter represented by reference numeral 113 when they are not discriminated from one another) are provided in correspondence with the four tablet feeders 90 so as to be located above the respective four tablet feeders 90. These shutter opening/closing switches 113 are used to temporarily open the shutter plates 92. When any one of the shutter opening/closing switch 113 is pushed, the shutter driving motor 110 of the tablet feeder 90 corresponding to the pushed shutter opening/closing switch 113 is driven, so that the shutter plate 92 is to the open state. After the open state concerned is kept for a constant time, the shutter plate 92 is set to the close state again.

FIG. 7 is a block diagram showing the functional construction of the tablet supply apparatus 1.

The controller 120 concentrically controls the respective parts of the tablet supply apparatus 1, and has CPU (Central Processing Unit) as an operation executing unit, a basic control program to be executed by CPU, ROM (Read Only Memory) for storing data associated with the basic control program, etc. in a non-volatile style, RAM (Random Access Memory) for temporarily a program to be executed by CPU, data associated with this program, etc., other peripheral circuits, etc. The controller 120 executes various kinds of time-counting operations and time-count of the present time on the basis of a reference clock generated by an oscillator (not shown).

This controller 120 is connected to the packaging machine 13, an interface unit 121, the tablet detecting sensor 18, the shutter solenoid 43, a motor driver 123, the display unit 37, the input unit 38, a storage unit 124 and the shutter opening/closing switches 113.

Under the control of the controller 120, the packaging machine 13 prepares separate packages filled with predetermined tablets and also feeds the prepared separate packages to the take-out port 82 by the conveyor 81 as described above.

The interface unit 121 is connected to a personal computer 122 through a signal communication cable or the like, and it transmits/receives various kinds of signals to/from the personal computer 122 under the control of the controller 120. According to this construction, various kinds of data can be transmitted/received between the personal computer 122 and the tablet supply apparatus 1, and also the operator can make various instructions to the tablet supply apparatus 1 through the personal computer 122.

The tablet detecting sensor 18 detects tablets discharged from the discharge drum, and outputs the detection value to the controller 120. The controller 120 counts the number of the tablets discharged from the discharge drum on the basis of the detection value input from the tablet detecting sensor 18. The shutter solenoid 43 actuates the shutters 53 under the control of the controller 120. The motor driver 123 is connected to the drum motor 14 and the shutter driving motor 110 and supplies driving current to these motors to control the driving of these motors under the control of the controller 120.

The display unit 37 displays various kinds of information under the control of the controller 120. The input unit 38 receives a user's input operation and output the input information to the controller 120.

The storage unit 124 comprises EEPROM or a flash memory, and stores various kinds of data in a rewritable style. Filling tablet data described later are stored in the storage unit 124.

As described above, the shutter opening/closing switches 113 is a switch which is pushed by the operator when the shutter plate 92 is opened. When the shutter opening/closing switch 113 is pushed, a signal indicating this fact is output from the shutter opening/closing switch 113 to the controller 120. The controller 120 to which the signal is input controls the motor driver 123 to supply driving current to the shutter driving motor 110, thereby controlling the driving of the shutter driving motor. Furthermore, the controller 120 sets the shutter plate 92 under the close state to the open state, keeps the open state for a predetermined period and sets the shutter plate 92 to the close state again.

The tablet supply apparatus 1 constructed as described above automatically and continuously prepares separate packages filled with predetermined kinds and numbers of tablets on the basis of the filling tablet data 124A generated on the basis of prescriptions.

Specifically, on the basis of a prescription prepared by a doctor or the like, the operator inputs information representing the kind and number of tablets to be filled in each separate package into the personal computer 122. The data representing the information input into the personal computer 122 is output through the interface unit 121 to the controller 120. The controller 120 generates the filling tablet data 124A on the basis of the data concerned, and stores the filling tablet data 124A into the storage unit 124.

FIG. 8 is a schematic diagram showing an example of the filling tablet data 124A. In FIG. 8, medicine T1 to medicine T320 represent the kinds of medicines existing in the tablet cases 3. Medicines X1 to X50 represent the kinds of medicines which do not exist in the tablet cases and are required to be added by using the tablet feeder 90 when they are filled in separate packages.

In the example of FIG. 8, the kind and number (amount) of medicines (tablets) to be filled every separate package are shown with respect to separate packages to be supplied to one hundred patients from patient J1 to patient J100. For example, A first separate package is a separate package to be supplied to the patient J1, and this separate package is filled with one tablet of the medicine T1. Furthermore, a second separate package is a separate package to be supplied to the patient J2, and this separate package is filled with two tablets of the medicine T2 and one tablet of the medicine X1. A third separate package is a separate package to be supplied to the patient J3, and this separate package is filled with one tablet of the medicine T3 and two tablets of the medicine X2. Furthermore, a one-hundredth separate package is a separate package to be supplied to the patient J100, and this separate package is filled with two tablets of the medicine T1 and one tablet of the medicine X3. In the example of FIG. 8, the tablet supply apparatus 1 continuously prepares one hundred separate packages filled with predetermined kinds and numbers (amounts) of tablets.

When preparation of separate packages by the tablet supply apparatus 1 is instructed, the controller 120 prepares the separate packages on the basis of the filling tablet data 124*a*. Here, the basic operation of the tablet supply apparatus 1 when one separate package is prepared will be described.

The controller 120 refers to the filling tablet data 124A, and specifies tablet cases 3 in which tablets to be filled in the separate package concerned are accommodated. Then, the controller 120 controls the motor driver 123 to drive the drum motor 14, and discharges the tablets from each tablet case 3. At this time, the tablet detection sensor 18 detects the tablets discharged from the tablet case 3, and outputs the detection value to the controller 120.

On the basis of the detection value input from the tablet detection sensor 18, the controller 120 counts the number (amount) of tablets discharged from the tablet case 3, and controls the motor driver 123 to stop the driving of the drum motor 14 at the stage that the predetermined number (amount) of tablets have been discharged. The tablets discharged from the tablet case 3 are passed through the chute 32, and temporarily trapped by the shutter 53. The controller 120 controls the shutter solenoid 43 to open the shutter 53 and make the tablets drop into the hopper 54, so that the tablets are filled through the nozzle 74 into the packaging sheet 72. The packaging sheet 72 filled with the tablets is compartmented by the thermal seal head 76 as described above, and cut out by the cutter 79, thereby preparing the separate package filled with the desired kinds and numbers (amounts) of tablets. The tablet supply apparatus 1 continuously prepare separate packages as described above on the basis of the filling tablet data 124*a*.

Here, when the kinds of tablets to be filled in a separate package to be prepared contain some kinds whose tablets are not set in any tablet case 3, it has been hitherto required to accommodate all the tablets concerned at a predetermined place before the separate package is prepared by the tablet supply apparatus 1. For example, after the tablet feeder mounted in the tablet supply apparatus is drawn out, the tablets concerned are put at a predetermined place of many accommodating compartments formed in the tablet feeder, and then the tablet feeder is put into the tablet supply apparatus 1 again. In this case, it takes time to draw out the tablet feeder and put the tablet feeder into the tablet supply apparatus again, and also a work of putting tablets at the predetermined place of small accommodating compartments is cumbersome.

Particularly, when separate packages to be supplied to many different patients are continuously prepared one by one, tablets are put into only one of many small accommodating compartments in the conventional tablet feeder, and thus the workability is low. On the other hand, according to this embodiment, the tablet supply apparatus 1 is equipped with the tablet feeder 90 described above, and the tablet supply apparatus 1 executes the following operation, whereby the work described above is simplified.

Figure 9:
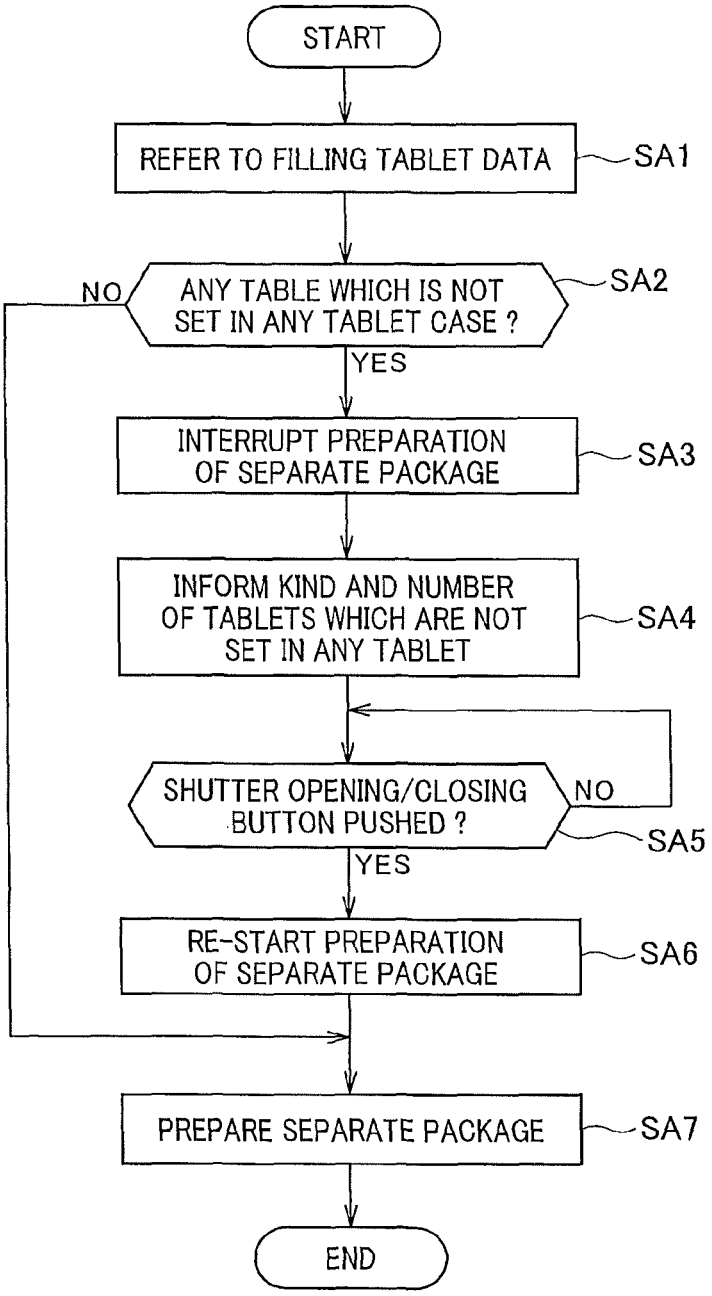
FIG. 9 is a flowchart showing an operation of the tablet supply apparatus.

FIG. 9 is a flowchart showing the operation of the tablet supply apparatus 1 when one separate package is prepared. It is assumed that information on the separate package to be prepared is input to the personal computer 122 at the time point when the operation shown in FIG. 9 is started.

The controller 120 of the tablet supply apparatus 1 refers to the filling tablet data 124A stored in the storage unit 124 (step SA1), and determines whether the tablets to be filled in the separate package contain any tablet which is not set in the tablet cases 3 (step SA2). In the case of the example of FIG. 8, when the medicines (tablets) to be filled in the separate package contain some of the medicine X1 to the medicine X50, it is determined that tablets which are not set in the tablet cases 3 are contained.

When there is not any tablet which is not set in the tablet cases 3 (step SA2: NO), the controller 120 controls the packaging machine 13 to prepare the separate package concerned (step SA7). On the other hand, when any tablet which is not set in the tablet cases 3 is contained (step SA2: YES), the controller 120 controls the packaging machine 13 to interrupt the preparation of the separate package (step SA3), and displays on the display unit 3 the kind and number (amount) of the tablets which are not set in the tablet cases 3, thereby informing this fact to the operator (step SA4). In the case of the example of FIG. 8, when the second separate package to be supplied to the patient J2 is prepared, one table for the medicine X1 is displayed on the display unit 37. Subsequently, the controller 120 monitors whether some shutter opening/closing switch 113 is pushed or not (step SA5). Here, the operation of the operator when the operation of the step SA4 and the step SA5 is executed will be described.

In step SA4, when the kind and number (amounts) of tablets which are not set in the tablet case 3 are displayed on the display unit 37, the operator prepare for this kind of tablets by the predetermined number (amount). Subsequently, the operator opens the lid member 98 of some tablet feeder 90, and puts the prepared tablets into the tablet putting port 99. Here, the put tablets are collected at the tablet collecting portion 107 as described above. Subsequently, the operator peeps at the tablet putting space 94 from the tablet putting port 99, and checks whether the put tablets are coincident with the tablets displayed on the display unit 37. As described above, the tablet collecting portion 107 is formed at the place where the operator can surely visually check (recognize), and thus the operator can surely perform the above check. When the operator confirms that the tablets are rightly put, the operator closes the lid member 98 and pushes the shutter opening/closing switch 113 corresponding to the tablet feeder 90 concerned. When the shutter opening/closing switch 113 is pushed, the shutter plate 92 under the close state is set to the open state, and the tablets are discharged into the hopper 54.

In step SA5, when the shutter opening/closing switch 113 is pushed (step SA5: YES), the controller 120 re-starts the preparation of the separate package (step SA6), and prepares the separate package (step SA7). At the time point when the preparation of the separate package of the step SA6 is re-started, the tablets which are to be filled in the separate package and also are not set in the tablet case 3 are discharged in the hopper 54, and thus the separate package filled with the tablets containing the tablets concerned is prepared in step SA7.

In the example described above, in step SA4, after the kind and number (amount) of tables are displayed on the display unit 37, the operator puts the tablets into the tablet feeder 90. However, when tables which are not set in the tablet cases 3 are known in advance, the tablets concerned may be prepared and put into some tablet feeder 90 in advance, and when they are displayed on the display unit 37, the shutter opening/closing switch 113 corresponding to the tablet feeder 90 in which the tablets concerned are put may be pushed. In this case, as compared with the case where the kind and number (amount) of the tablets are displayed on the display unit 37 and then the operator prepares for these tablets, the time required for the work can be shortened. Particularly, in this embodiment, the four tablet feeders 90 are prepared, and thus tablets associated with the four separate packages at maximum can be put in the respective tablet feeders 90 in advance, and thus the time required for the work can be further shortened.

As described above, according to this embodiment, the tablet feeder 90 has the shutter unit 91. When tablets are put into the tablet feeder 90 through the tablet putting port 99, the put tablets are collected at the tablet collecting unit 107 formed on the shutter plate 92, and temporarily trapped there, so that the operator can surely visually check these tablets. Furthermore, there is provided the shutter opening/closing switch 113 for setting the shutter plate 92 of the shutter unit 91 to the open state on the basis of the user's instruction.

According to this construction, in a case where one separate package is prepared by the tablet supply apparatus 1, when there are tablets which are to be filled in this separate package and are not set in any tablet case 3, the operator puts the tablets concerned through the tablet putting port 99 of the tablet feeder 90 at the preparation stage of the separate package, and also visually check whether the tablets collected at the tablet collecting unit 107 are correct or not. Thereafter, the operator pushes the shutter opening/closing switch 113 to set the shutter plate 92 to the open state, thereby adding the tablets concerned. In this case, before the separate package is prepared by the tablet supply apparatus 1, the advance preparation of preparing for tablets which are not set in any tablet case 3 and putting the tablets concerned into a predetermined place is simplified, and thus the simplification of the advance preparation can be performed. Particularly, when the kinds of tablets which are not set in any tablet case 3 are various, discreteness is required for the advance preparation and the time required for the work is increased. However, in this embodiment, the advance preparation can be simplified, and thus the advance preparation can be more greatly simplified.

Furthermore, in this embodiment, as shown in FIG. 1, the shutter opening/closing switch 113 is provided in the neighborhood of the tablet feeder 90 corresponding to the shutter opening/closing switch 113. According to this construction, when tablets are put into the tablet feeder 90, the shutter opening/closing switch 113 can be pushed immediately after the put tablets are checked, and the convenience for the user can be enhanced. Furthermore, the corresponding relation between the shutter opening/closing switch 113 and the tablet feeder 90 can be made clear.

In this embodiment, in step SA4 of FIG. 9, after the kind and number (amount) of tablets are displayed on the display unit 37, the operator puts the tablets into the tablet feeder 90. However, when tablets which are not set in any tablet case 3 are known in advance, the tablets concerned may be prepared and put into some tablet feeder 90 in advance, and when the tablets are displayed on the display unit 37, the shutter opening/closing switch 113 corresponding to the tablet feeder 90 concerned in which the tablets concerned are put may be pushed. In this case, as compared with the case where the kind and number (amount) of tablets are displayed on the display unit 37 and then the operator prepares for these tablets, the time required for the work can be shortened. Particularly, in this embodiment, the four tablet feeders 90 are provided, and thus the tablets associated with the four separate packages at maximum can be put in the tablet feeders in advance. Therefore, the time required for the work can be further shortened.

<Modification>

Figure 10:
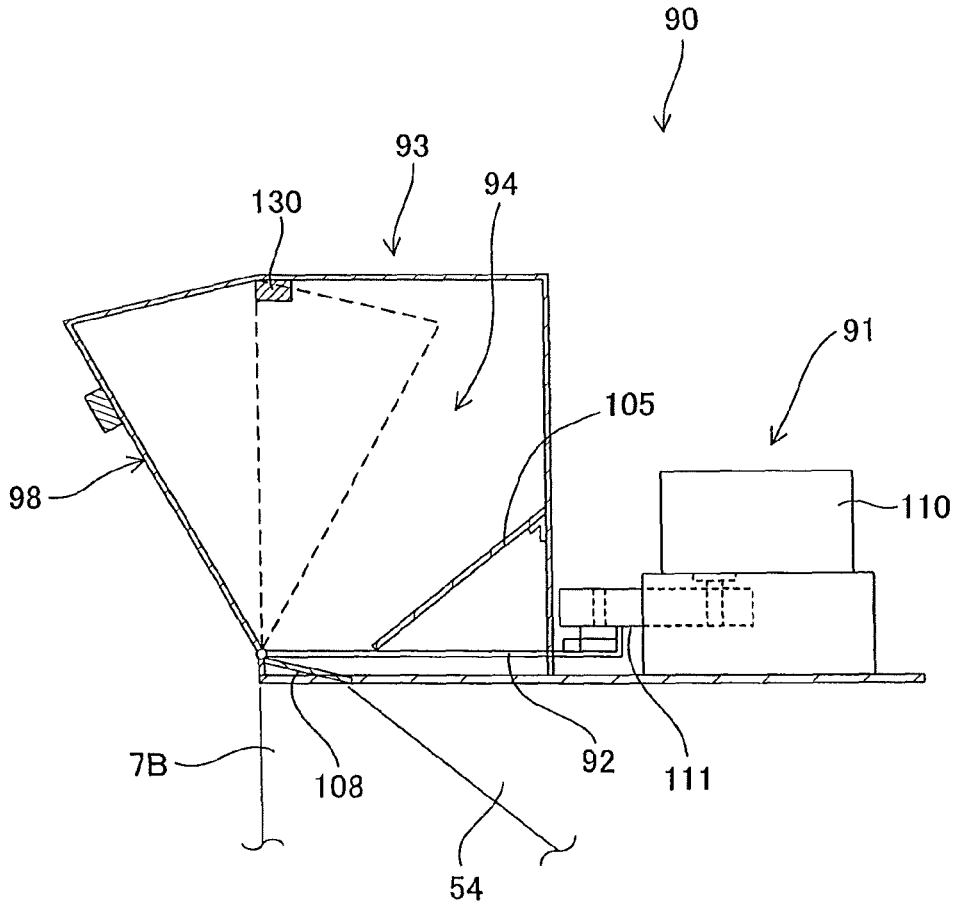
FIG. 10 is a side view showing a modification of a tablet feeder.

FIG. 10 is a diagram showing a modification of the tablet feeder 90. As shown in FIG. 10, the tablet feeder 90 has a switch 130 such as a limit switch or the like which is turned on when the lid member 98 is set to the close state and turned off when the lid member 98 is set to the open state. This switch 130 is connected to the controller 120, and the controller 120 detects the open state/close state of the lid member 98 on the basis of ON or OFF of the switch 130. When the controller 120 detects that the lid member 98 is changed from the close state to the open state and then set to the close state again, the controller 120 controls the driving of the shutter driving motor 110 by the motor driver 123 so that the shutter plate 92 under the close state is set to the open state and then sets to the close state again after a predetermined time.

According to this construction, in a case where the operator adds tablets through the tablet feeder 90 into the tablet supply apparatus 1, when the lid member 98 is set to the open state, the tablets are put into the tablet feeder 90 and then the lid 98 is set to the close state again, the shutter plate 92 is automatically set to the open state, and the put tablets are introduced into the hopper 54. Accordingly, the operator is not required to intentionally press the shutter opening/closing switch 113 after putting the tablets into the tablet feeder 90, and thus the convenience for the operator can be enhanced.

Figure 11A:
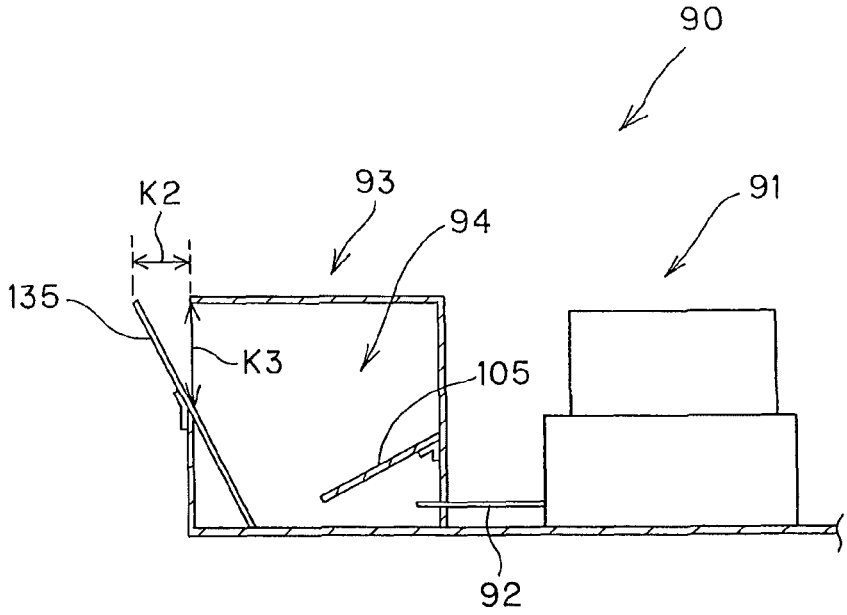
FIG. 11A is a side view showing a modification of the tablet feeder.

FIG. 11A is a diagram showing another modification of the tablet feeder 90. In this modification, an opening K3 is formed at the upper portion of the front surface of the tablet feeder main body 93, and also a slope plate 135 which is inclined downwardly toward the rear side is provided so as to penetrate through the opening K3. An opening K2 is formed between the upper end of the slope plate 135 and the front end of the upper surface of the tablet feeder main body 93, and when tablets are put into the tablet feeder main body 93, the operator puts the tablets through the opening K2 and the opening K3 into the tablet putting space 94 formed in the tablet feeder main body 93. According to this construction, the lid which is freely openable/closable is not provided to the tablet feeder 90, and thus the user's work of opening/closing the lid can be omitted.

Figure 11B:
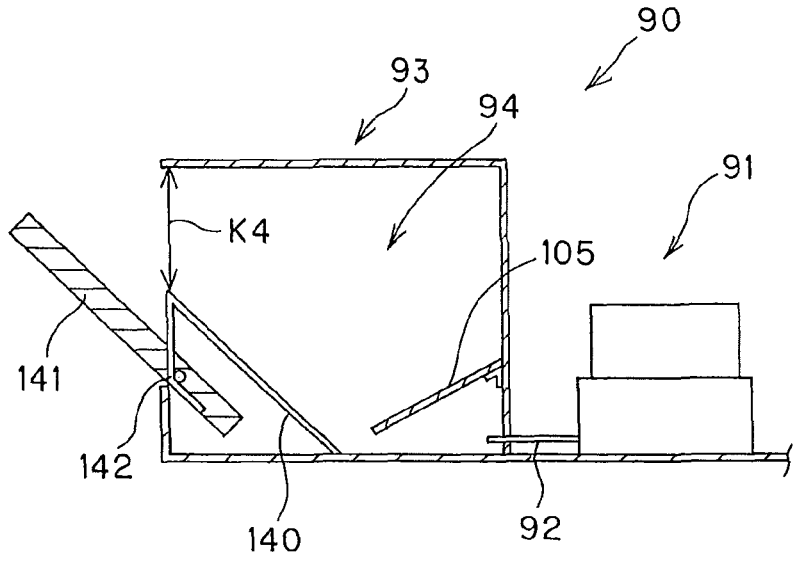
FIG. 11B is a side view showing a modification of the tablet feeder.

FIG. 11B is a diagram showing another modification of the tablet feeder 90. In this embodiment, an opening K4 is formed at the upper portion of the front side of the tablet feeder main body 93, and also a slope plate 140 which is downwardly inclined toward the rear side is provided so as to be joined to the lower end of the opening K4. Furthermore, a lid member 141 which is swingable around a shaft 142 and closes the opening K4 is provided. According to this construction, the same effect as the above-described embodiment can be obtained.

The present invention is not limited to the above embodiment, and various modifications and applications can be performed without departing from the subject matter of the present invention.

For example, in the above embodiment, the shutter opening/closing switch 113 is provided above the tablet feeder 90. However, it may be provided to the control panel 36 which is provided so as to be near to the tablet feeder 90.

Furthermore, instep SA4 of FIG. 9, the kind and number (amount) of tables are displayed on the display unit 37, however, they may be output with voices.

In the above embodiment, the four tablet feeders are provided. However, the number of tablet feeders is not limited to four, and at least one tablet feeder may be provided.

What is claimed is:

1. A tablet supply apparatus; comprising:

a main body including an upper portion and a lower portion;

a case accommodating unit provided in the upper portion;

a plurality of shelves provided in the case accommodating unit, the plurality of shelves configured to be drawn out forward of the main body;

a plurality of tablet cases secured in each of the shelves, each of the tablet cases configured to accommodate a tablet;

a tablet feeder provided on a front face of the lower portion, the tablet feeder configured to open forward of the main body, wherein the tablet feeder includes, a tablet feeder body including a space formed in the tablet feeder body for putting an additive tablet on a bottom of the space, an opening formed at front of the tablet feeder body and a lid member provided at the opening such that, the lid member opens forward of the main body, the lid member is movable between an open state under which the additive tablet is allowed to be put into the space and a close state under which the additive tablet is not allowed to be put into the space, the lid member is configured to be turnable in a front-and-rear direction around an axis extending in a horizontal direction, and wherein when the lid member is in the open state, the lid member is set to be inclined to a part of the bottom of the space such that the additive tablet is allowed to be guided along the inclined lid member to the part of the bottom of the space, and a shutter unit configured in the part of the bottom of the space and configured to open the part of the bottom of the space to drop the additive tablet, a hopper provided in the lower portion and below the plurality of tablet cases and the tablet feeder, the hopper configured to receive the tablet dropped from each of the tablet cases or the additive tablet dropped from the tablet feeder; and a filling device provided in the lower portion and configured to fill the tablet or the additive tablet discharged from the hopper.

2. The tablet supply apparatus according to claim 1, wherein the tablet feeder body further includes a slope plate inclined downwardly toward a front side such that the additive tablet is allowed to be guided along the slope plate to the part of the bottom of the space.

3. The tablet supply apparatus according to claim 2, wherein the shutter unit includes a shutter plate configured to move rearward to open the part of the bottom from a close state in which the shutter plate is forefront.

4. The tablet supply apparatus according to claim 1, further comprising:

a plurality of the tablet feeders provided on the front face of the lower portion, the plurality of tablet feeders configured to respectively open forward of the main body.

5. The tablet supply apparatus according to claim 1, wherein the tablet feeder further includes a switch provided on the front face of the lower portion of the main body, the switch connecting to the shutter unit, the hopper configured to receive the additive tablet dropped from the tablet feeder, wherein when the switch is pushed, the shutter unit opens the part of the bottom to drop the additive tablet into the hopper; and the filling device configured to fill the additive tablet discharged from the hopper.

6. The tablet supply apparatus according to claim 5, wherein the switch is configured to be in an active state when the lid member is in the close state.

* * * * *